United States Patent [19]

Barns-Slavin et al.

[11] Patent Number: 5,072,397

[45] Date of Patent: Dec. 10, 1991

[54] CARRIER MANAGEMENT SYSTEM ENABLING DETERMINATION OF CHARGES WITH DISCOUNTS

[75] Inventors: Ileana D. Barns-Slavin, Wilton; Clint F. Brandien, Prospect; Alonzo T. Dukes, Bridgeport; David J. Taylor, Norwalk, all of Conn.

[73] Assignee: Pitney Bowes Inc., Stamford, Conn.

[21] Appl. No.: 489,310

[22] Filed: Mar. 5, 1990

[51] Int. Cl.[5] ..... G07B 17/02

[52] U.S. Cl. ..... 364/464.02; 177/25.15; 364/464.03

[58] Field of Search ..... 364/464.02, 464.03; 177/25.15

[56] References Cited

U.S. PATENT DOCUMENTS

| | | | |
|---|---|---|---|
| 4,325,440 | 4/1982 | Crowley et al. | 177/25.15 |
| 4,420,819 | 12/1983 | Price et al. | 364/900 |
| 4,495,581 | 1/1985 | Piccione | 364/464.03 |
| 4,589,555 | 5/1986 | Hollingsworth | 209/703 |
| 4,595,984 | 6/1986 | Daniels | 364/466 |
| 4,713,761 | 12/1987 | Sharpe et al. | 364/406 |
| 4,839,813 | 6/1989 | Hills et al. | 364/464.01 |
| 4,868,757 | 9/1989 | Gil | 364/464.03 |
| 4,872,119 | 10/1989 | Kajimoto | 364/464.03 |
| 4,873,645 | 10/1989 | Hunter et al. | 364/464.02 X |
| 4,900,941 | 2/1990 | Barton et al. | 235/462 X |
| 5,019,991 | 5/1991 | Sansone et al. | 364/464.03 |

*Primary Examiner*—Parshotam S. Lall
*Assistant Examiner*—Edward R. Cosimano
*Attorney, Agent, or Firm*—Nathaniel Levin; Melvin J. Scolnick; Robert H. Whisker

[57] ABSTRACT

A carrier management system includes a scale for weighing parcels to be shipped, a computer connected to receive data from the scale related to the weight of a parcel thereon, and a keyboard enabling operator input to the computer. The keyboard has a plurality of keys including a plurality of selection keys corresponding to separate ones or groups of the carriers and/or classes. The computer stores shipping charge data for a plurality of carriers and/or shipping classes, on the basis of weight data from the scale. A second memory receives and stores discount data from the keyboard, corresponding to discounts allocable to any of the carriers and/or classes. The computer is responsive to operation of the selection keys for applying discounts stored in the second means to any carrier and/or class to which they are applicable.

7 Claims, 5 Drawing Sheets

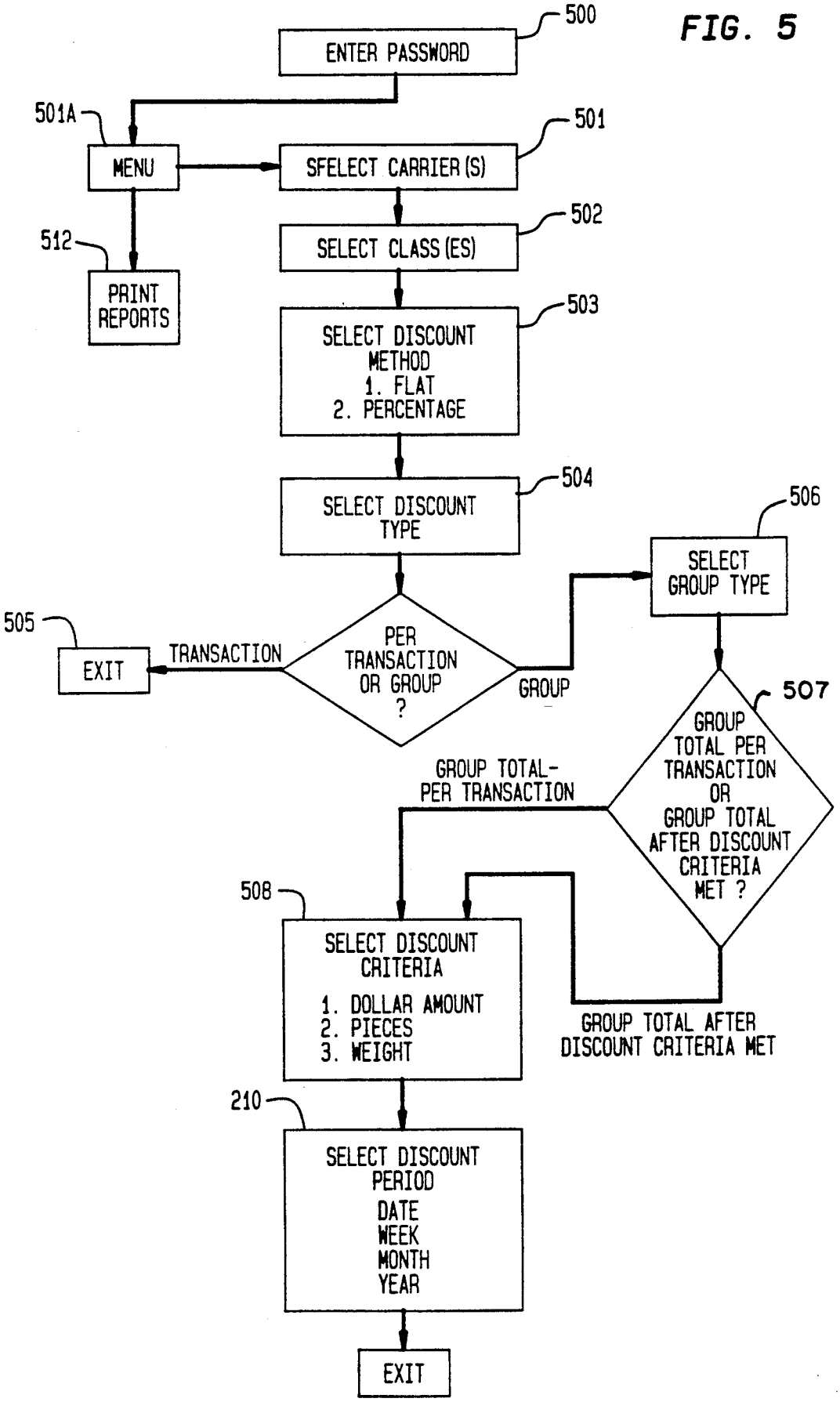
FIG. 5
500
ENTER PASSWORD
501A
MENU
501
SFELECT CARRIER (S)
512
PRINT REPORTS
502
SELECT CLASS (ES)
503
SELECT DISCOUNT METHOD
1. FLAT
2. PERCENTAGE
504
SELECT DISCOUNT TYPE
506
SELECT GROUP TYPE
505
EXIT
TRANSACTION
PER TRANSACTION OR GROUP ?
GROUP
507
GROUP TOTAL PER TRANSACTION OR GROUP TOTAL AFTER DISCOUNT CRITERIA MET ?
GROUP TOTAL-PER TRANSACTION
508
SELECT DISCOUNT CRITERIA
1. DOLLAR AMOUNT
2. PIECES
3. WEIGHT
GROUP TOTAL AFTER DISCOUNT CRITERIA MET
210
SELECT DISCOUNT PERIOD
DATE
WEEK
MONTH
YEAR
EXIT

CARRIER MANAGEMENT SYSTEM ENABLING DETERMINATION OF CHARGES WITH DISCOUNTS

FIELD OF THE INVENTION

This invention relates to carrier management systems adaptable to enable a user to determine the shipping costs for shipping of parcels via a number of different carriers and/or classes, and is more in particular directed to such a system wherein discounts can be readily introduced in such a system for use in cost determination.

BACKGROUND OF THE INVENTION

In the shipping of parcels, it is frequently desirable to make provision for shipping by more than one carrier. In current shipping practice, provision must be made for the shipping of parcels by two major carriers, such as the United State Postal System (USPS) and the United Parcel Service (UPS), a private carrier, as well as any of a large number of smaller private carriers. In prior tracking or recording systems, various data concerning parcels or groups of parcels to be shipped were entered by an operator, so that the information could be stored in the records of a memory. The "transactions" recorded included information relating to the shipment, such as, for example, the identification of the carrier, the number of packages in the shipment, the weight, address data, charges, date and time, invoice number, etc. Factors such as weight were entered either manually or automatically by a scale, while other factors such as zip code were generally entered by an operator by way of a keyboard. Such systems contemplated the provision in the programs of routines that determined shipping costs on the basis of the information that was input.

Systems of this type are disclosed, for example, in U.S. Pat. Nos. 4,325,440; 4,495,581 and 4,595,984. The prior art does not, however, disclose a system wherein a simple and programmable arrangement is provided enabling an operator to readily and automatically apply discounts for the given carriers and/or classes, for a given shipment.

SUMMARY OF THE INVENTION

The invention is therefore directed to the provision of a carrier management system enabling a user to readily program discounts into the system, and to automatically employ these discounts in the determination of shipping charges.

Briefly stated, the invention comprises a carrier management system including a scale for weighing parcels to be shipped, a computer connected to receive data from the scale related to the weight of a parcel thereon, and a keyboard enabling operator input to the computer. The keyboard has a plurality of keys including a plurality of selection keys corresponding to separate ones or groups of the carriers and/or classes, and means for entering shipping data corresponding to the shipment of the parcel. The computer has first memory means for storing shipping charge data for a plurality of carriers and/or shipping classes, on the basis of weight data from the scale. In accordance with the invention, second memory means are provided for receiving and storing discount data from the keyboard, corresponding to discounts allocable to any of the carriers and/or classes, and the computer comprises means responsive to operation of the selection keys for applying discounts stored in the second memory means to any carrier and/or class to which they are applicable. The selection keys may include at least one key corresponding to a plurality of the carriers and/or classes. The computer is preferably responsive to entry of the discount data via the keyboard.

The discount data corresponds to one or more of the carriers and/or classes, and may include data concerning whether the discount is a flat or percentage discount, whether the discount is applicable to each transaction or to a group of transactions, whether the discount criteria is monetary, by numbers of pieces or by total weight of shipped parcels, and/or the time period for which the discount is applicable.

A printer may be provided as a part of the system to enable the user to appraise the benefits obtained by the discounts, for past transactions.

While reference is made herein to various memories, it is apparent that some of these memories may form different parts of a common memory.

BRIEF DESCRIPTION OF THE DRAWING

In order that the invention may be more clearly understood, it will now be disclosed in greater detail with reference to the accompanying drawing, wherein:

FIG. 5 is a flow diagram of the system of the present invention.

DETAILED DISCLOSURE OF THE INVENTION

Figure 1:
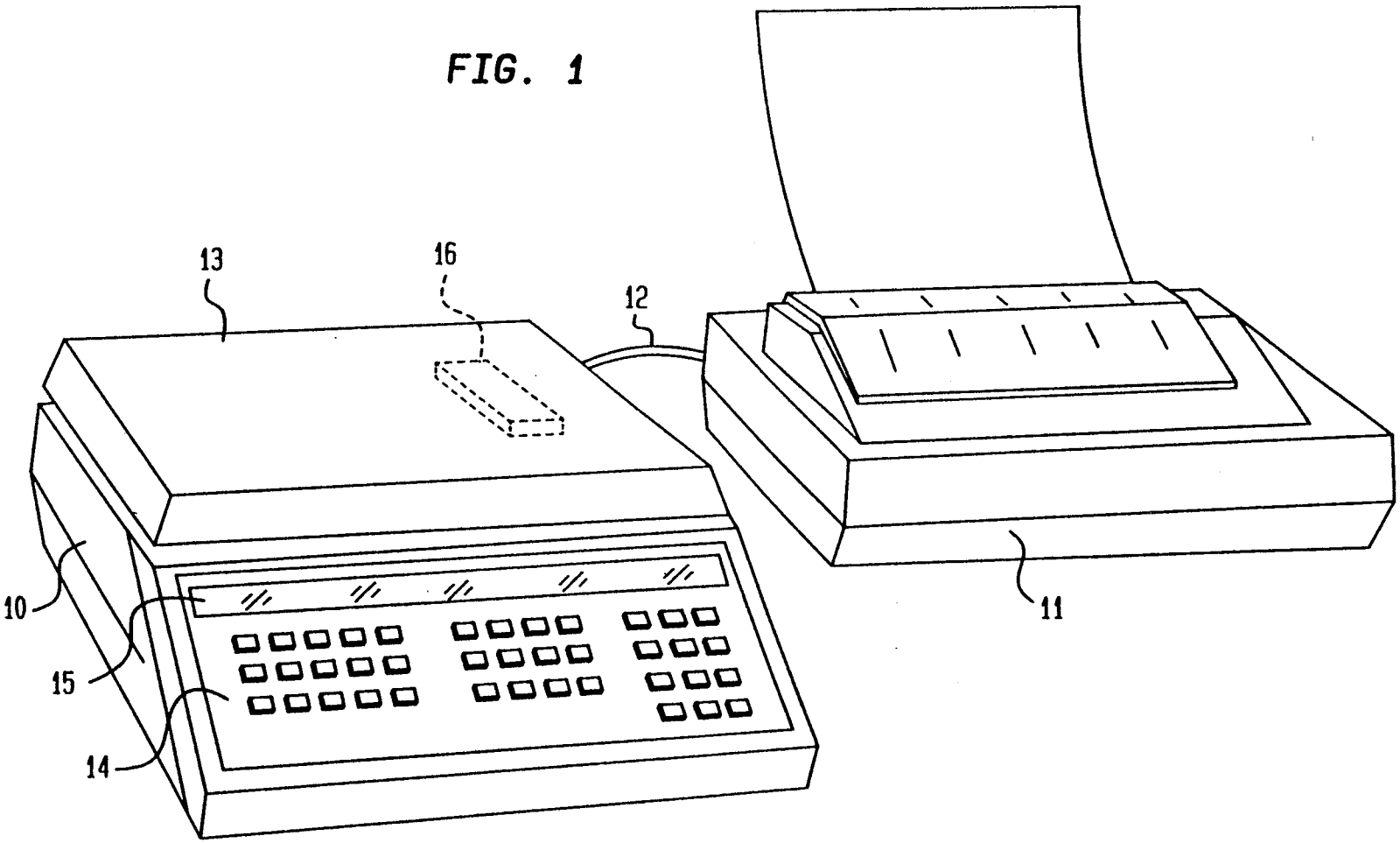
FIG. 1 is a perspective illustration of a carrier management system that may incorporate the present invention.

Referring now to the drawings, FIG. 1 is a perspective view of a carrier management system that may be employed in the present invention, including a console 10 and an optional printer 11 coupled thereto via cable 12. The console supports a platform 13 for receiving parcels to be weighed. The front panel of the console includes a keyboard 14 and a display 15. A replaceable board 16, illustrated in dashed lines, is mounted on or in the console below the platform, this board 16 having one or more ROM's or PROM's thereon. These ROM's store data that may be unique to the user of the system, are replaceable by other ROM boards in order, for example, to enable a serviceman to gain access to critical setup programs stored in other NVM in the console.

Figure 2:
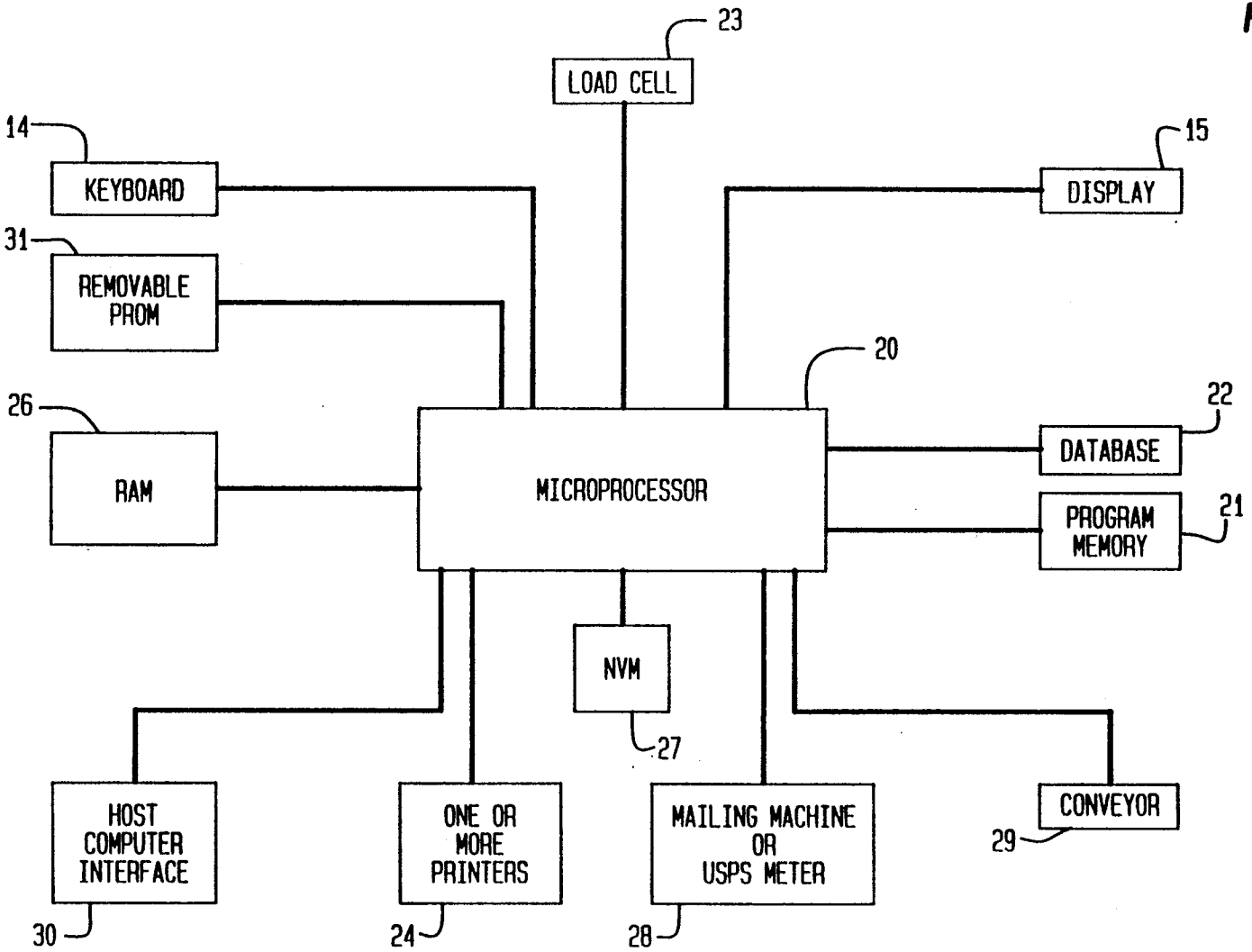
FIG. 2 is a block diagram of the system of FIG. 1.

FIG. 2 is a block diagram of the carrier management system of FIG. 1. The system incorporates a microcomputer including a microprocessor 20 having a nonvolatile program memory 21 containing the program for operation of the system, and a nonvolatile database memory 22 having stored therein rate information of all carriers for which the system is expected to determine cost data. This latter memory is preferably replaceable in order to be able to update rate information, change or add carriers and/or classes of service, etc. A load cell 23 coupled to the platform applies data to the microprocessor related to the weight of a parcel on the platform.

The system further includes one or more printers 24, one of which may be the printer 11 illustrated in FIG. 1, and another of which may be internal to the system, if desired. The system may have working RAM 26, and further NVM 27, and may be adapted to be connected to a mailing machine or USPS meter 28, a conveyor 29, and/or a host computer interface 30.

The system in accordance with the invention is adapted to determine mailing or shipping charges for a parcel placed on the platform 13, and may be adapted to print a manifest, label, tag, etc. related to the shipping of the parcel, and/or it may include internal registers for accounting for the shipping of such parcels.

Figure 3:
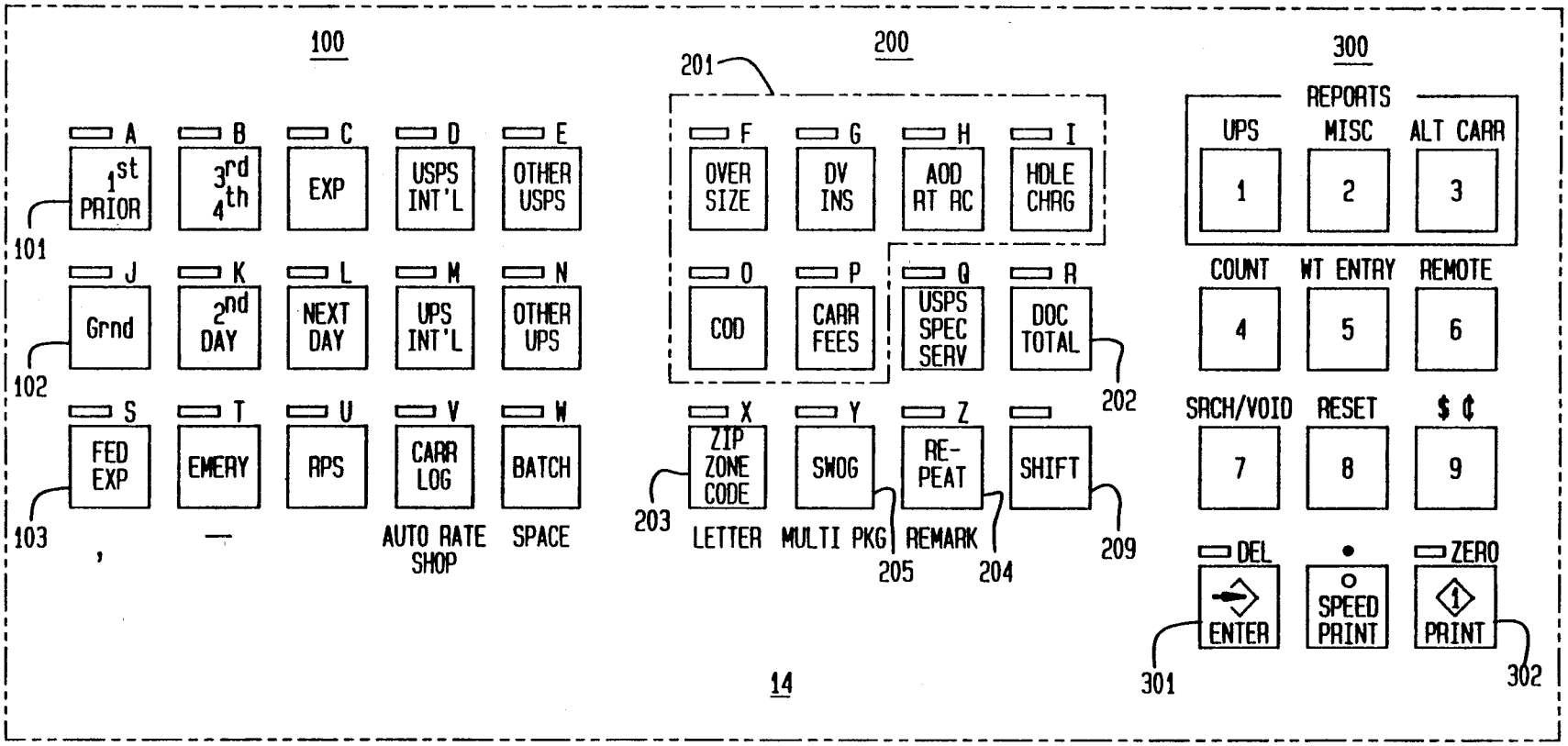
FIG. 3 is an illustration of the keyboard of the system of FIG. 1.

Referring now to FIG. 3, therein is illustrated the keyboard 14 of a preferred carrier management shipping system in accordance with the invention. The keyboard includes three sets 100, 200, 300 of keys. Each of the keys has a label printed thereon corresponding to the primary function of the key. Secondary and tertiary functions are printed above and below the keys showing additional functions that depression of the associated the keys may enable.

The group 100 of keys includes three rows 101, 102, 103 of keys, each row having five keys. These keys are known as the carrier/class keys, since their primary function is concerned with the selection of the carrier to use for shipping a given parcel, or the class of shipment that is to be employed for the shipment. For example, the keys of the first row 101 may be concerned with shipments by the USPS, and depression of any of these keys automatically selects shipping via USPS, with the specific class being determined by the key in the row that is depressed. Thus, depression of the first key in the row indicates that calculations should be made on the basis of first class or priority class mailing. These calculations are based upon the weight of the parcel. If priority class is to be selected, by the depression of this key, a response will be made to a later prompt for an input of the zip or zone of destination. Similarly, depression of the second key selects third or fourth class mail, depression of the third key selects express mail, depression of the fourth key selects USPS international mail, and depression of the fifth key in the row selects other classes, the specific selection of other classes being in response to prompts on the display.

Depression of a key of the second row 102 of keys automatically selects UPS as the carrier, with the various keys of this row hence being directed to various classes of shipping via UPS.

In the third row 103 of keys, the first three keys are directed to the shipping costs of a group of carriers, such as Federal Express, Purolator, DHL, Emery, etc., so that depression of the corresponding key enables the system to determine the shipping charges, for the current parcel, of each of these carriers. Various shipping classes may also be analyzed in response to the depression of these keys, such as, for example, drop shipments.

The fourth key in the row 103 enables the user to select infrequently used carriers and/or classes from a menu that appears on the display. Such selection may require the user to calculate the shipping charges, since the rates for these carriers and/or classes may not be stored in the system.

Selection of the last key in the row 103 enables the user to process a group of parcels as a single transaction.

The second group 200 of keys includes a group 201 of toggle keys enabling the user to select or deselect special services. These keys may include, for example, a key for oversize parcels to require shipping charge determination to be also based upon the size of the parcel, a key requiring addition of insurance charges, a key including charges for a return receipt, a key for COD shipments, a key to call a menu for special services for alternate carriers, etc.

In addition, this group 200 of keys includes a key 202 to effect printing of accumulated values for a group of parcels, a key 203 to change the zip or zone identification, a key 204 to repeat the data of the previous transaction and a key 205 to process the parcel for shipment with other goods. In addition, the group 200 includes the SHIFT key 209 which enables selection of second and third functions of various ones of the other keys.

The third group 300 of keys enables numeric entry by the user, in response to prompts for such entries from the display, and also includes an ENTER key 301 for enabling entering of certain responses, and a PRINT key 302 for causing the printing of the manifest, label, tape, and/or the entering of data into internal registers, etc.

Most of the keys also have a second function printed above the key, the second function being effected upon depression of the SHIFT key 209 and the respective key. In addition, a third function is printed below a number of the keys, the third function being effected by depression of this key along with the SHIFT key (only in the event that depression of the key for effecting the second function would have not have resulted in a valid entry). If depression of a key for performing a primary function would have been invalid, such depression causes the selection of the second function, without depression of the SHIFT key, if the respective second function constitutes a valid response to a prompt at that time.

As is apparent in FIG. 3, the second functions of a number of the keys correspond to the letters A-Z. The second functions of the keys of the first row of the group 300, however, are commands for the printing of various reports, such as UPS, a miscellaneous carrier, or a carrier to be selected from a menu. The first key in the second row of group 300 may direct the system to count parcels of the same weight, the second key in this row may enable manual entry of the weight, and the third key in this row allows entry of weight from a remote scale.

As illustrated, only a few of the keys serve third functions. Other keys permit entry of various punctuation, and a space.

Figure 4:
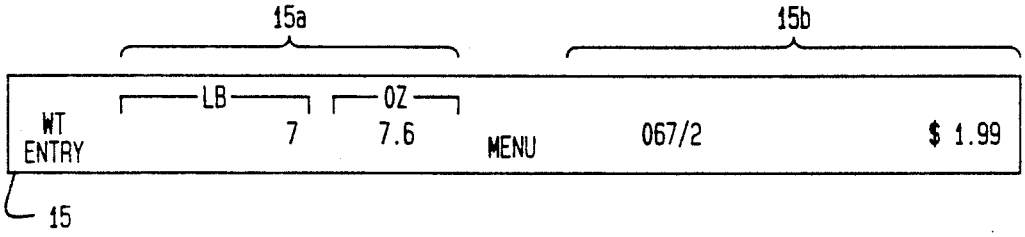
FIG. 4 is an illustration of the display of the system of FIG. 1.

FIG. 4 illustrates a display 15 that may be employed in the carrier management system of the invention. As illustrated, the display includes a section **15*a* that displays the weight of a parcel on the platform, for example in pounds and ounces. The other portion 15*b* of the display is employed for various alphanumeric messages. These messages may include various menus and lists of choices (that may be scrolled by the user), responses given by the user such as the zip code and zone messages shown in the figure, as well as prompts, etc., as well as, at the right end of the portion 15*b***, the shipment cost that has been calculated by the system.

In use of the above described system, i.e. not considering the specific features of the present invention, a parcel is placed upon the platform 13, and, in response thereto, a message is displayed prompting the user to enter an identification number of the parcel. When an identification number has been entered, the user may be optionally prompted to enter user definable, customer related information associated with the parcel to be shipped, as well as remarks concerning the parcel. Next the user is prompted to enter a carrier/class selection. In response thereto, the user depresses one of the keys of row 101 of keyboard section 100, if the parcel is to be shipped by USPS, or one of the keys of row 102 of keyboard section 100 if the parcel is to be shipped by UPS. The separate keys of these two rows correspond to different classes of service. Some of these keys may correspond to more than one class of service, in which case a menu is displayed and scrolled on the display to permit the operator to select the desired class of service. For example, the first key in row 101 may enable the user to select either first class or priority USPS mail service, and the second key in this row may enable the user to select either third or fourth class USPS mail service. Following this selection, the user is prompted to enter the Zip code, in response to which the user enters a 3 digit ZIP code (i.e. the most significant 3 digits of the Zip code). The system now displays the weight of the parcel at the section 15*a* of the display, the 3 digit Zip code and Zone at the section 15*b* of the display, and the shipping charges at the section 15*b* of the display.

If desired, the user may now depress one or more of the special charge keys in the section 201 of the keyboard. For example, if the parcel is oversize, the first key in the first row of this section is depressed, following which the display shows the additional charges for an oversize parcel. After a predetermined time, the display will show the total charges for shipping the parcel including the oversize parcel charges. The other special charge keys function in a similar manner to add charges for other special services.

At this time, if the user is satisfied with the entries that have been made, the print key 302 is depressed and the parcel is removed from the platform, to complete the transaction. The system now proceeds to print any desired documents, tags, tapes or labels, and, if the program requires, to perform any necessary accounting functions.

In carrier management, it is frequently possible to take advantage of discounts offered by one or more of the carriers, in one or more of the shipping classes. Such discounts may be voluntarily offered, or they may be negotiated with the carriers. They may be based upon any of a number of factors, as will be discussed, and they may be applicable for only a given time period. It is accordingly not feasible to provide and insert a new rate table ROM every time that a new discount rate is made applicable to any of the carriers and/or classes. In accordance with the invention, this disadvantage is overcome by enabling the user to introduce and/or change a discount rate structure in the system that is applicable only to designated carriers and/or classes.

In order to enter such discounts in the memory of the system, for inclusion in the determination of charges for the respective carriers and/or classes, the user first enters a password into keys of the keyboard, as shown at block 500 of FIG. 5. This entry may call up a multilevel menu subroutine 501*a* to provide the user at any level with various program options, including the option to enter or change discount rates. Upon selection of this option, the program prompts the user to enter a carrier, to which the user responds by operating one of the carrier and/or class keys, corresponding to the carrier and/or class for which the discount will be applicable, at block 501. Upon this entry, the system prompts the user to enter a class or classes to which the discount will be applicable, at block 502. The system responds to this entry by prompting the entry of a discounting method (block 503), i.e. whether the discount is to be a flat (fixed) discount for all applicable parcels, or if it will be a percentage discount. The user then enters the desired selection in the keyboard. If a flat discount is chosen, the user will then enter the amount, e.g. in dollars and cents, and if a percentage rate is chosen, the user will enter the percentage rate.

The user is next prompted to enter the discount type, at block 504, i.e. whether the discount is applicable to each transaction, or whether it is applicable only to a given group of transactions. If the user operates the keys to indicate that the discount is application for each transaction, the program exits, at block 505, for example to return to the menu for entry of further discounts, or other procedures. If the user selects the discount to be applicable to a group of transactions, the system then prompts the user to select the group type, at block 506. This selection enables the user (at block 507) to program the discount rate to be either applicable to each transaction of the group to be selected, or to be applicable to the group total after the criteria for the group of parcels has been met.

If the user has entered a type, e.g. "flat" or "percent", a prompt is displayed for entry of the discount criteria, at block 508. The user now has the choice of entering a selection that the discount will be based upon the dollar amount of usage of the carrier and/or class by the shipper, the number of pieces for which the carrier and/or class has been used by the shipper, or the total weight of parcels that have been shipped by the carrier and/or class. After entry of the desired selection, the user is now prompted, at block 210, to enter the time period for which the discount is to be applicable. In one arrangement in accordance with the invention, the discount automatically starts on the date it was entered, and the user is prompted to enter a response of whether the discount will be applicable for a day, a week, a month or a year. It is of course apparent that other techniques may be employed for entering a desired time period. After the user enters the desired period, the program exits, for example to the menu for further entries.

It is of course apparent that other techniques may be employed for entering discount information. The responses to the prompts are preferably simple in form, such as Y(es) or N(o) to questions that have two choices, or numeric entries based upon items listed in the various menus, in accordance with conventional practice.

The system of the invention stores data corresponding to previous transactions with each carrier and/or class, so that it can determine the cost of the current shipment on the basis of any discounts that are applicable. The discounts are of course not applied to the other carriers/classes, unless they have been so programmed.

In a further aspect of the invention, the system may print reports to enable the user to determine how much use had been made of the various discounts, thereby enabling the user to take as much advantage of the discounts as possible. For example, the menu 501*a* may enable the selection of a subroutine 512 for printing such reports.

While the invention has been disclosed and described with reference to a single embodiment, it will be apparent that variations and modification may be made therein, and it is therefore intended in the following claims to cover each such variation and modification as falls within the true spirit and scope of the invention.

What is claimed is:

1. A carrier management system comprising a scale for weighing parcels to be shipped, a computer connected to receive data from said scale related to the weight of a parcel thereon, the computer having first memory means for storing shipping charge data for a plurality of shipping classes, on the basis of weight data from said scale, and a keyboard enabling operator input to said computer, said keyboard having a plurality of keys including a plurality of selection keys corresponding to separate ones or groups of said classes, means for entering shipping data corresponding to the shipment of said parcel, and second memory means, said computer being programmed to:

(a) receive from said keyboard a signal indicating that discount rate data is to be entered;

(b) respond to said signal by prompting an operator to select a class for which said discount data is to be entered;

(c) respond to operation of one of said selection keys by prompting said operator to enter said discount data, said discount data to be applied to a class corresponding to said one selection key;

(d) receive said discount data and store said discount data in said second memory means; and (e) apply said discount data to a shipment transaction, for which said class is selected.

2. The carrier management system of claim 1 wherein at least one of said selection keys corresponds to a plurality of said classes.

3. The carrier management system of claim 1 further comprising printing means, said computer comprising means for printing a report of usage of discount charges of transactions entered in said system.

4. The carrier management system of claim 1 wherein said discount data comprises data indicating whether a flat discount or a percentage discount is applicable.

5. The carrier management system of claim 1 wherein said discount data comprises data indicating whether a discount is to be based upon a monetary amount of shipping charges or upon a number of parcels shipped or upon the weight of parcels shipped.

6. The carrier management system of claim 1 wherein said discount data comprises data indicating a time period for which a discount is applicable.

7. In a carrier management system including a scale for weighing parcels to be shipped, a computer connected to receive data from said scale related to the weight of a parcel thereon, the computer having a first memory means for storing shipping charge data for a plurality of carriers, and means for calculating a shipping charge on the basis of said charge data and weight data from said scale, and a keyboard enabling operator input to said computer, said keyboard having a plurality of keys including a plurality of selection keys corresponding to separate ones or groups of said carriers, means for entering shipping data corresponding to the shipment of said parcel, and second memory means for storing discount data, a method of entering discount rate data comprising the steps of:

(a) selecting an option to enter said discount data;

(b) prompting an operator to select a carrier for which said discount data is to be entered;

(c) selecting said carrier by operating one of said selection keys, said selected carrier corresponding to said one of said selection keys;

(d) entering said discount data by use of said keyboard; and (e) storing said discount data in said second memory means.

* * * * *